US009168539B2

(12) United States Patent
Lübbecke

(10) Patent No.: US 9,168,539 B2
(45) Date of Patent: Oct. 27, 2015

(54) METHOD OF APPLYING THERMOPLASTIC LIQUID ONTO A SUBSTRATE

(71) Applicant: Nordson Corporation, Westlake, OH (US)

(72) Inventor: Kai Lübbecke, Wittorf (DE)

(73) Assignee: Nordson Corporation, Westlake, OH (US)

( * ) Notice: Subject to any disclaimer, the term of this patent is extended or adjusted under 35 U.S.C. 154(b) by 240 days.

(21) Appl. No.: 14/084,912

(22) Filed: Nov. 20, 2013

(65) Prior Publication Data

US 2014/0065305 A1 Mar. 6, 2014

Related U.S. Application Data

(62) Division of application No. 13/165,280, filed on Jun. 21, 2011, now Pat. No. 8,640,641.

(60) Provisional application No. 61/361,038, filed on Jul. 2, 2010.

(51) Int. Cl.

| | |
|---|---|
| ***B05D 5/10*** | (2006.01) |
| ***B05B 1/00*** | (2006.01) |
| *B05C 5/02* | (2006.01) |

(52) U.S. Cl.

CPC ..... *B05B 1/00* (2013.01); *B05C 5/0275* (2013.01); *B05C 5/0262* (2013.01); *B05C 5/0266* (2013.01)

(58) Field of Classification Search

CPC ..... B05B 1/00; B05C 5/0254; B05C 5/0266; B05C 5/0262

USPC ..... 427/207.1

See application file for complete search history.

(56) References Cited

U.S. PATENT DOCUMENTS

| | | | |
|---|---|---|---|
| 4,753,587 | A | 6/1988 | Djordjevic et al. |
| 5,305,955 | A | 4/1994 | Smitherman et al. |

(Continued)

FOREIGN PATENT DOCUMENTS

| | | | |
|---|---|---|---|
| CN | 101244415 | A | 8/2008 |
| CN | 101559410 | A | 10/2009 |

(Continued)

OTHER PUBLICATIONS

European Patent Office, European Search Report in EP Application No. 07117015, Aug. 20, 2008.

(Continued)

*Primary Examiner* — Xiao Zhao

(74) *Attorney, Agent, or Firm* — Wood, Herron & Evans, LLP

(57) ABSTRACT

Apparatus and methods for applying liquid onto a substrate include a nozzle configured to be connected to a liquid source. The nozzle further includes a distribution passage with a length that can receive the liquid. A piston is positioned in the distribution passage and a slit-shaped nozzle opening is in fluid communication with the distribution passage. The piston is movable in the distribution passage so as to vary the length that can receive the liquid. The nozzle opening communicates with the distribution passage via a plurality of spaced apart outlet channels having respective outlet ends. The outlet channels are formed between first and second nozzle pieces each having a tip portion at the outlet ends. At least one of the first or second nozzle pieces is flexible at the tip such that the outlet ends open when under positive fluid pressure and close when the fluid pressure is reduced. An application valve is coupled to the nozzle for selectively interrupting or enabling a flow of liquid to the distribution passage.

14 Claims, 2 Drawing Sheets

(56) References Cited

U.S. PATENT DOCUMENTS

| | | | | |
|---|---|---|---|---|
| 5,423,668 | A | 6/1995 | Cloeren | |
| 5,665,401 | A | 9/1997 | Serbin et al. | |
| 6,371,392 | B1 | 4/2002 | Steinman | |
| 6,540,831 | B1 | 4/2003 | Craine et al. | |
| 7,332,035 | B1 | 2/2008 | Tudor et al. | |
| 7,465,356 | B2 | 12/2008 | Rudolph et al. | |
| 2006/0131344 | A1 | 6/2006 | Brass | |
| 2006/0213434 | A1 | 9/2006 | Ganzer et al. | |
| 2008/0134966 | A1 | 6/2008 | Luebbecke et al. | |
| 2009/0022890 | A1* | 1/2009 | Takahashi | B01F 3/04992 427/243 |

FOREIGN PATENT DOCUMENTS

| | | | |
|---|---|---|---|
| DE | 4130432 | A1 | 3/1993 |
| DE | 10103375 | C1 | 6/2002 |
| DE | 10253410 | A1 | 1/2004 |
| DE | 20308257 | U1 | 9/2004 |
| EP | 1260277 | A2 | 11/2002 |
| EP | 1683632 | A2 | 7/2006 |
| GB | 196960 | A | 5/1923 |
| GB | 1503511 | A | 3/1978 |
| JP | 7-4364 | | 1/1995 |
| WO | 00/67914 | A2 | 11/2000 |
| WO | 2004/103577 | A1 | 12/2004 |

OTHER PUBLICATIONS

European Patent Office, Partial European Search Report in EP Application No. 11172367, Feb. 23, 2012.

State Intellectual Property Office of the People's Republic of China, Office Action in CN Application No. 2014122301562830, Dec. 26, 2014.

Japanese Patent Office, Office Action in JP Application No. 2011-147081, May 29, 2015.

* cited by examiner

METHOD OF APPLYING THERMOPLASTIC LIQUID ONTO A SUBSTRATE

CROSS-REFERENCE TO RELATED APPLICATIONS

This application is a divisional of application Ser. No. 13/165,280, filed Jun. 21, 2011 (pending) which claims the priority of U.S. Provisional Patent Application Ser. No. 61/361,038, filed on Jul. 2, 2010, the disclosures of which are incorporated by reference herein.

TECHNICAL FIELD

The present invention relates to an apparatus for applying fluids such as adhesive and in particular, hot melt adhesive, onto a substrate that is movable relative to the apparatus.

BACKGROUND

U.S. Published Application No. 2008/0134966 (the '966 application) discloses a width adjustable multi-slot applicator or gun. The disclosure of the '966 application is hereby fully incorporated by reference herein. This existing gun incorporates a nozzle having multiple fluid outlet channels spaced apart from each other and receiving pressurized fluid from a common distribution passage or channel. A movable piston is positioned for lengthwise movement in the distribution channel. The piston is used to modify the fluid application pattern and, in particular, the width of the application pattern. For this purpose, the slit between the nozzle opening and the distribution channel is segmented by the respective outlet channels. Therefore, flow components in the longitudinal or lengthwise direction of the slit can be largely prevented and this results in more uniform fluid application when orienting the nozzle vertically. The piston is used to select which of the outlet channels have adhesive flowing through them. The outlet channels located in the section of the distribution channel sealed off by the piston are prevented from receiving fluid. In this manner, the width of fluid application is variable in steps as determined by the number of outlet channels that are not blocked off by the piston.

One challenge experienced with apparatus of the above-described type is that residual adhesive will exit the outlet channels for a short period of time immediately after the main valve of the applicator is closed. Then, upon restart of the applicator, the next substrate or substrates in the production run may not receive adequate adhesive. It would therefore be desirable to prevent this from occurring and provide a system and method whereby substrates immediately after a production stoppage continue to receive uniform application of adhesive.

SUMMARY

Generally, apparatus for applying thermoplastic liquid onto a substrate is provided and includes a slot nozzle configured to be connected to a source of the thermoplastic liquid. The slot nozzle includes a distribution channel or passage and a slit-shaped nozzle outlet in fluid communication with the distribution passage. The slit-shaped nozzle outlet is formed between first and second nozzle pieces each having a tip portion. At least one of the first or second nozzle pieces is flexible at its tip portion such that the nozzle outlet opens when under positive fluid pressure applied by the thermoplastic liquid and closes when the fluid pressure of the thermoplastic liquid is reduced or deactivated. In one embodiment, an application valve is coupled to the nozzle for selectively interrupting or enabling a flow of the thermoplastic liquid to the distribution passage.

In another embodiment, a piston is positioned in the distribution passage. A slit-shaped nozzle opening is in fluid communication with the distribution passage. The piston is movable in the distribution passage so as to vary the length that can receive the liquid. The nozzle opening communicates with the distribution passage via a plurality of spaced apart outlet channels having respective outlet ends. The outlet channels are formed between first and second nozzle pieces each having a tip portion at the outlet ends. At least one of the first or second nozzle pieces is flexible at the tip such that the outlet ends open when under positive fluid pressure and close when the fluid pressure is reduced.

Each of the outlet channels can include a flow interrupting element extending across the corresponding outlet channel. This flow interrupting element operates to close the outlet end when the fluid pressure is reduced or deactivated, for example, to zero by closure of the application valve. To provide flexibility, the first nozzle piece can include a recessed portion that essentially causes the tip portion to act like a living hinge to allow the tip of the first nozzle piece to flex away from the tip of the second nozzle piece. This then opens the outlet ends of the outlet channels under the positive fluid pressure. That is, as the positive fluid pressure builds sufficiently, the flexible portion or portions will flex to spread apart the first and second nozzle pieces at the tips by a slight amount. In the event that both nozzle pieces flex, the nozzle may be designed such that each tip portion moves half of the total required distance under a given pressure. For example, the hydraulic or fluid pressure may be 20 bar (290 psi) with the total tip portion movement being 0.02 mm. The outlet channels may be formed by depressions on a surface of at least one of the first or second nozzle piece. The spacings between the outlet channels may be such that the liquid delivered through the nozzle opening forms a continuous surface, or such that the liquid delivered through the nozzle opening defines a plurality of spaced apart strips. The strips may be of desired width, from thin beads to wide bands or ribbons. The movement of the piston selectively enables or interrupts the flow of liquid through one or more outlet channels to vary the application width of the liquid.

A method is provided for applying thermoplastic liquid onto a substrate. The method involves connecting a slot nozzle to a source of thermoplastic liquid, with the nozzle including a distribution passage communicating with a slit-shaped outlet. This slit-shaped outlet is formed between first and second nozzle pieces each having a tip portion at the outlet. The method further includes supplying pressurized thermoplastic liquid from the source to the distribution passage, moving the tip portion of at least one of the first or second nozzle pieces with hydraulic pressure created by the pressurized thermoplastic liquid to open the outlet, and dispensing the thermoplastic liquid from the opened slit-shaped outlet onto the substrate.

Another method of applying thermoplastic liquid onto a substrate is provided and uses a nozzle connected for fluid communication with a source of the liquid. The nozzle includes outlet channels formed between first and second nozzle pieces each having a tip portion at the outlet ends. Pressurized liquid is supplied from the source to the outlet channels. The outlet ends are opened by moving the tip portion of at least one of the first or second nozzle pieces away from the tip portion of the other nozzle piece using the hydraulic pressure created by the pressurized liquid in the outlet channels. The liquid is then dispensed from the open outlet ends onto the substrate. To stop dispensing the liquid, the outlet ends of the outlet channels are closed by reducing or deactivating the hydraulic pressure. Other aspects of the method will become more readily apparent upon review of the further discussion herein.

Additional features and advantages of the invention will become more readily apparent to those of skill in the art upon review of the detailed description of the illustrative embodiments taken in conjunction with the accompanying drawings.

DETAILED DESCRIPTION OF THE ILLUSTRATIVE EMBODIMENTS

FIGS. 1-4 and 5A illustrate a first embodiment of a slot nozzle 10. It should be noted that the nozzle 10 shown in these figures is adapted for use in the applicator disclosed in the '966 application. Thus, the various components disclosed in the '966 application that are not shown or described herein may be used with the nozzles disclosed herein for purposes of dispensing liquids, such as hot melt adhesive or other thermoplastics. The features of the nozzle 10 that are different than those disclosed in the '966 application are described hereinbelow.

As illustrated in FIGS. 1-4, the nozzle 10 generally includes first and second nozzle pieces 12, 14 which together define a liquid distribution channel or passage 16. The nozzle pieces 12, 14 may be formed as completely separate components that are fastened together for assembly and disassembly or may be formed in any other suitable manner. The distribution passage 16 is formed with a suitable cross sectional shape, such as cylindrical, for receiving a piston (not shown), as described in the '966 application. The nozzle 10 is configured to be connected to a liquid source (not shown) in a manner that provides positively pressurized liquid, such as hot melt adhesive, to the distribution passage 16. The distribution passage 16 is in fluid communication with a slit-shaped nozzle opening 18. The piston is movable along the length of the distribution passage 16 so as to vary the length that can receive the liquid and thereby vary the width of the liquid application pattern dispensed from the nozzle 10.

Figure 1:
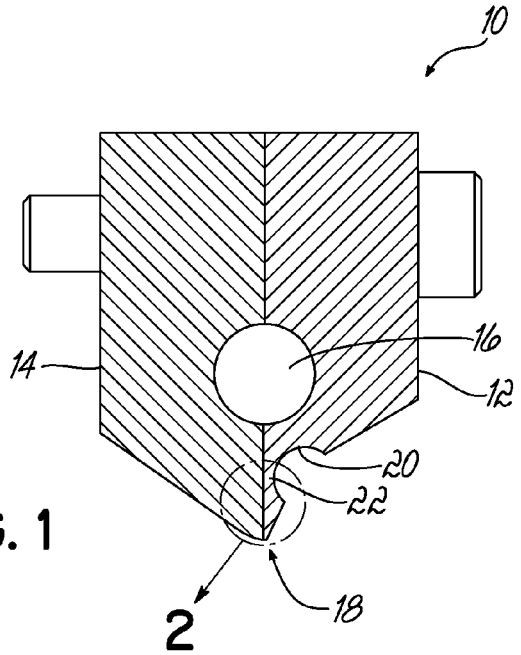
FIG. 1 is a transverse cross section of a nozzle constructed in accordance with an embodiment of the invention.
Figure 2:
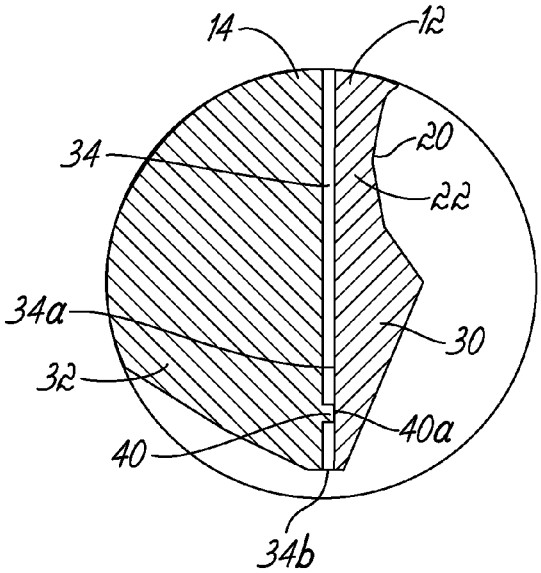
FIG. 2 is an enlarged view of area "2" as indicated on FIG. 1.
Figure 3:
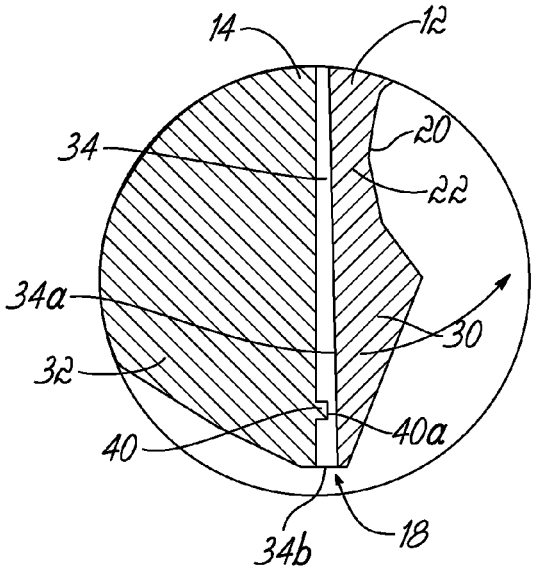
FIG. 3 is a view similar to FIG. 2, but illustrating the opening of the liquid or fluid channel outlet end under the influence of positive fluid pressure in the channel.
Figure 4:
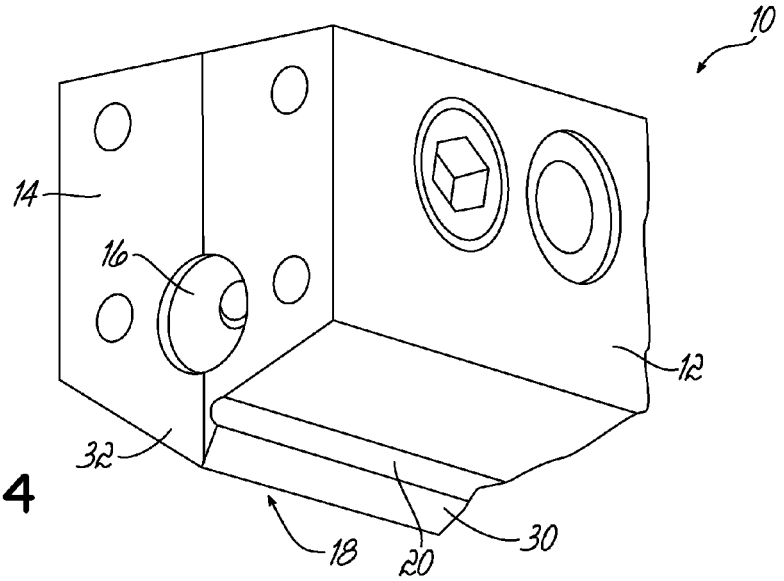
FIG. 4 is a perspective view of the nozzle illustrated in FIG. 1.

The first nozzle piece 12 has a recessed area 20 forming an area of reduced material thickness 22. This area 22 acts essentially like a living hinge which provides a resilient bias or flexibility for normally maintaining the opening 18 in a closed or sealed condition as shown in FIG. 2. The material forming the nozzle 10 may be conventional, such as stainless steel, or may be another material that allows for a slight amount of elasticity. The elasticity of the material and the effect of the living hinge configuration of first nozzle piece 12 causes a tip portion 30 of the first nozzle piece 12 to move away from a tip portion 32 of the second nozzle piece 14 as shown in FIG. 3 when the liquid is supplied to the distribution passage 16 under conventional pressures used for hot melt adhesive application. This movement of tip portion 30, as shown in FIG. 3, may be approximately 0.02 mm.

Figure 5A:
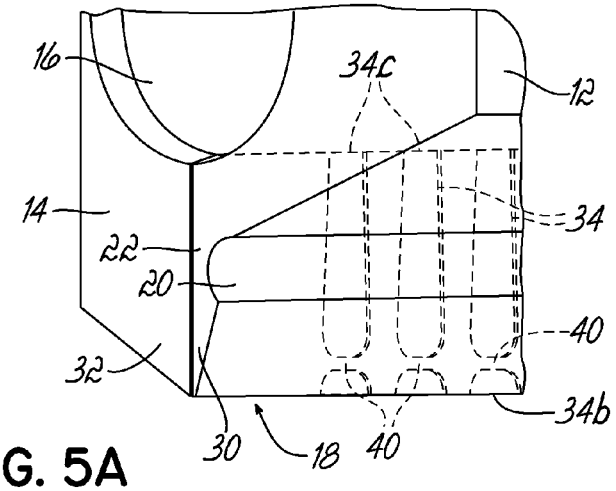
FIG. 5A is an enlarged perspective view of the outlet end of the nozzle shown in FIG. 4.

As best shown in FIGS. 2, 3 and 5A, the outlet channels 34 each include a flow interrupting element or ligament of material 40 extending transverse to the channel 34 and having a sealing surface 40*a* that engages the inner surface 34*a* of the channel associated with the tip portion 30 of the first nozzle piece 12. Thus, when the liquid is not under pressure or at least is under sufficiently reduced pressure, the first nozzle piece 12 will be biased to a normally closed position and seal against the second nozzle piece 14 by contact of the flow interrupting element 40 as shown in FIG. 2. When liquid is supplied under a sufficient positive pressure, such as 20 bar (290 psi) the tip portion 30 of the first nozzle piece 12 will move away from the tip portion 32 of the second nozzle piece 14 under the influence of the hydraulic pressure. The length or amount of this movement is designed to be 0.02 mm but, of course, may vary depending on application needs. The liquid will then discharge through the outlet ends 34*b* of the channels 34 as long as the pressure is maintained.

The outlet channels 34 may be formed by depressions on an inner surface of at least one of the first or second nozzle pieces 12, 14. An illustrative spacing of the respective outlet channels 34 is shown in FIG. 5A. The spacing between the channels 34 may be chosen such that the pattern of liquid delivered through the outlet ends forms either a continuous liquid surface or a plurality of spaced apart liquid strips. As will be further understood from a review of FIG. 5A, the piston (not shown) positioned in the distribution passage 16 may be moved along the length of the distribution passage 16 to selectively interrupt the flow of liquid through one or more of the inlet ends 34*c* of the outlet channels 34. This will vary the width of the liquid application pattern delivered from the slit-shaped opening 18 of the nozzle 10.

Figure 5B:
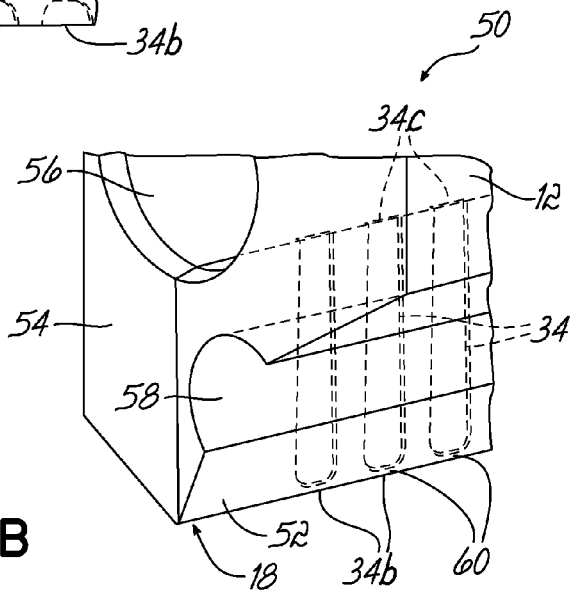
FIG. 5B is a perspective view similar to FIG. 5A, but illustrating an alternative embodiment of the nozzle.

FIG. 5B illustrates an alternative embodiment of a nozzle 50 having first and second nozzle pieces 52, 54 and a distribution passage 56. The first nozzle piece 52 has a somewhat differently shaped recessed portion 58 that is enlarged compared to the embodiment illustrated in FIG. 5A. Flow interrupting elements 40 of the first embodiment illustrated in FIG. 5A are positioned slightly inboard of the outlet ends 34*b*. However, in the second embodiment of FIG. 5B, flow interrupting elements 60 are positioned directly at the outlet ends 34*b*. In all other respects, the embodiment of FIG. 5B operates as previously described.

It will be appreciated that when the fluid pressure is reduced, such as when the main applicator valve is closed and a production run is stopped, the liquid in the respective outlet channels 34 will be retained therein as the movable tip portion 30 will immediately engage the respective flow interrupting elements or ligaments 40. Therefore, when the applicator valve is subsequently opened to restart the production run, the liquid retained in the outlet channels 34 will be immediately available and dispensed onto a substrate, such as a label. This will ensure that labels will receive liquid, such as adhesive, immediately upon restart of a production run.

While the present invention has been illustrated by a description of various illustrative embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or any combinations depending on the needs and preferences of the user. However, the invention itself should only be defined by the appended claims.

What is claimed is:

1. A method of applying thermoplastic liquid onto a substrate, comprising:

connecting a nozzle to a source of the liquid, the nozzle including outlet channels formed between first and second nozzle pieces each having a tip portion at the outlet ends, supplying pressurized liquid from the source to the outlet channels, opening the outlet ends by moving the tip portion of at least one of the first or second nozzle pieces away from the tip portion of the other nozzle piece using the hydraulic pressure created by the pressurized liquid in the outlet channels, and dispensing the liquid from the open outlet ends onto the substrate.

2. The method of claim 1, further comprising:

closing the outlet ends of the outlet channels by reducing or deactivating the hydraulic pressure to cause the tip portions to seal together.

3. The method of claim 2, wherein closing the outlet ends further comprises using respective flow interrupting elements extending across the outlet channels.

4. The method of claim 1, wherein moving the tip portion further comprises resiliently flexing the tip portion of one of the first or second nozzle pieces relative to the other of the first or second nozzle pieces.

5. The method of claim 1, wherein dispensing the liquid further comprises:

dispensing the liquid from the outlet channels such that the liquid forms a continuous surface on the substrate.

6. The method of claim 1, wherein dispensing the liquid further comprises:

dispensing the liquid from the outlet channels such that the liquid forms a plurality of spaced apart liquid strips on the substrate.

7. The method of claim 1, further comprising:

blocking liquid from flowing into one or more of the outlet channels in order to vary the liquid application width.

8. A method of applying thermoplastic liquid onto a substrate, comprising:

connecting a slot nozzle to a source of the thermoplastic liquid, the nozzle including a distribution passage communicating with a slit-shaped outlet, the slit-shaped outlet formed between first and second nozzle pieces each having a tip portion at the outlet, supplying pressurized thermoplastic liquid from the source to the distribution passage, moving the tip portion of at least one of the first or second nozzle pieces with hydraulic pressure created by the pressurized thermoplastic liquid to open the slit-shaped outlet, and dispensing the thermoplastic liquid from the open, slit-shaped outlet onto the substrate.

9. The method of claim 8, further comprising:

closing the slit-shaped outlet by reducing or deactivating the hydraulic pressure.

10. The method of claim 9, wherein closing the slit-shaped outlet further comprises using at least one flow interrupting element extending across an outlet channel.

11. The method of claim 8, wherein moving the tip portion further comprises flexing a living hinge at the tip portion of one of the first or second nozzle pieces relative to the other of the first or second nozzle pieces.

12. The method of claim 8, wherein dispensing the thermoplastic liquid further comprises:

dispensing the liquid from the outlet such that the liquid forms a continuous surface on the substrate.

13. The method of claim 8, wherein dispensing the thermoplastic liquid further comprises:

dispensing the liquid from the outlet such that the liquid forms a plurality of spaced apart strips on the substrate.

14. The method of claim 8, further comprising:

blocking the thermoplastic liquid from flowing into one or more of portions of the outlet in order to vary an application width of the liquid.

* * * * *